US007347745B1

(12) United States Patent
Raudenbush et al.

(10) Patent No.: US 7,347,745 B1
(45) Date of Patent: Mar. 25, 2008

(54) THREE POSITION ELECTRICAL CONNECTOR ASSEMBLY

(75) Inventors: James Michael Raudenbush, Halifax, PA (US); John Wesley Hall, Harrisburg, PA (US); Douglas John Hardy, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/624,745

(22) Filed: Jan. 19, 2007

(51) Int. Cl.
*H01R 13/54* (2006.01)

(52) U.S. Cl. ..... 439/752; 439/595

(58) Field of Classification Search ..... 439/752, 439/595, 489, 744, 746
See application file for complete search history.

(56) References Cited

U.S. PATENT DOCUMENTS 5,098,315 A * 3/1992 Scowen ..... 439/587
5,252,096 A * 10/1993 Okada ..... 439/752
5,342,223 A * 8/1994 Geib ..... 439/752
5,928,038 A * 7/1999 Berg et al. ..... 439/752
6,422,903 B1 * 7/2002 Fekonja et al. ..... 439/752
6,676,445 B2 1/2004 Hall et al.
6,824,403 B2 11/2004 Hall et al.
6,994,598 B2 * 2/2006 Holmes et al. ..... 439/752.5
2004/0038596 A1 * 2/2004 Bartholoma et al. ..... 439/752
2005/0106950 A1 * 5/2005 Fink et al. ..... 439/752

* cited by examiner

*Primary Examiner*—Hien Vu

(57) ABSTRACT

A housing is provided for use in an electrical connector assembly. The housing includes a body having at least one axial passageway for receiving an electrical connector. A position assurance device extends into at least one axial passageway and is configured to engage a shoulder of the electrical connector to restrict axial movement thereof. A secondary position assurance device is received in the body engaging a shoulder of the electrical connector to restrict axial movement thereof.

18 Claims, 9 Drawing Sheets

THREE POSITION ELECTRICAL CONNECTOR ASSEMBLY

FIELD OF THE INVENTION

The present invention relates generally to electrical connectors and, more particularly, to a three position coaxial cable connector assembly.

BACKGROUND OF THE INVENTION

Radio frequency (RF) coaxial cable connector assemblies have been used for numerous automotive applications, such as global positioning systems (GPS), car radios, mobile phones, air bag systems, and multimedia devices. Coaxial cables typically consist of an outer conductor, an inner conductor, a dielectric, and a jacket. The outer conductor and the inner conductor of the cable often electrically interface with a mating coaxial cable through jack and plug connectors. Such conventional coaxial cable connectors are known in the art, for example, in U.S. Pat. Nos. 6,676,445 and 6,824,403, which are assigned to the assignee of the present invention and are expressly incorporated by reference herein.

Certain automotive applications may require that multiple coaxial cables be coupled through a single connector assembly. For example, three position connector assemblies are often used to electrically couple three coaxial jack connectors with three coaxial plug connectors.

In order to standardize various types of connectors and thereby avoid confusion, certain industry standards have been established. One of these standards is referred to as FAKRA. FAKRA is the Automotive Standards Committee in the German Institute for Standardisation, representing international standardization interests in the automotive field. The FAKRA standard provides a system, based on keying and color coding, for proper connector attachment. Like jack keys can only be connected to like plug keyways in FAKRA connectors. Secure positioning and locking of connector housings is facilitated by way of a FAKRA defined catch on the jack housing and a cooperating latch on the plug housing.

Typically, electrical connector assemblies have retention means in a housing in order to secure the electrical connectors therein. One such retainer is a plastic movable member which is configured to move in place over the connector to lock the connector in place. Some of such movable members are moved transversely to the axial direction, while others are designed as hinged flaps which are rotated into place.

However, prior to insertion of the retention means inside the connector housing to secure the electrical connectors in place, typically the electrical connectors must be aligned within the housing. In other words, if the electrical connectors are not aligned, it is typically not possible to insert the retention means. Further, there is no easy or convenient way to determine whether the electrical connectors have been properly aligned, thus further complicating the installation.

What is needed is an electrical connector housing that easily permits alignment of the electrical connectors and further provides a convenient, consistent manner to determine when the electrical connectors have been properly aligned.

SUMMARY OF THE INVENTION

The present invention relates to a housing for use in an electrical connector assembly. The housing includes a body having at least one axial passageway for receiving an electrical connector. A position assurance device extends into the at least one axial passageway and is configured to engage a shoulder of the electrical connector to restrict axial movement. A secondary position assurance device is received in the body engaging the shoulder of the electrical connector to restrict axial movement of the electrical connector.

The present invention further relates to a housing for use in an electrical connector assembly. The housing includes a body having a first channel for receiving a first electrical connector. A first position assurance device extends into the first channel and is configured to engage a shoulder of the first electrical connector to restrict axial movement of the first electrical connector. The body has a second channel for receiving a second electrical connector. A second position assurance device extends from the second channel and is configured to engage a shoulder of the second electrical connector to restrict axial movement of the second electrical connector. The body has a third channel for receiving a third electrical connector. A third position assurance device extends from the third channel and is configured to engage a shoulder of the third electrical connector to restrict axial movement of the third electrical connector. A secondary position assurance device is received in the body to engage a shoulder of each of the electrical connectors to restrict axial movement of the electrical connectors.

The present invention yet further relates to an electrical connector assembly. The electrical connector assembly includes a housing including a plurality of axial passageways, a transverse slot and a plurality of position assurance devices. A plurality of electrical connectors is configured to be received within the plurality of axial passageways. Each of the electrical connectors includes a shell having a shoulder and an annular groove, each shoulder engaging a corresponding position assurance device. A secondary position assurance device is configured to be received within the transverse slot. The secondary position assurance device includes a plurality of arcuate engagement surfaces, each of the engagement surfaces configured to be received within one of the annular grooves of the shells.

An advantage of the present invention is that electrical connectors can be aligned and secured within a connector housing with position assurance devices.

A further advantage of the present invention is that the position assurance devices are of unitary construction with the connector housing.

A still further advantage of the present invention is that a secondary position assurance device is used with the position assurance device to secure the electrical connectors.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
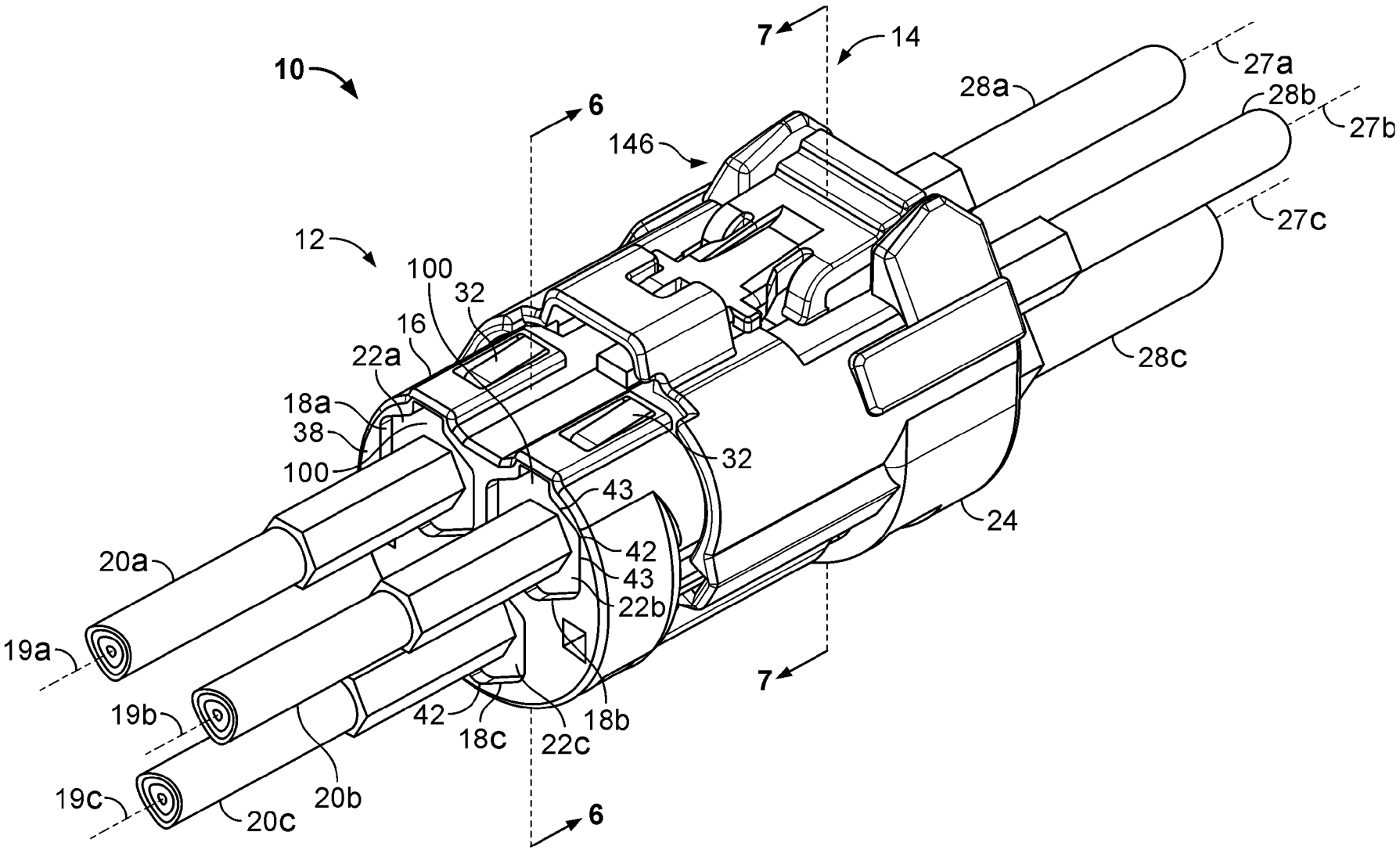
FIG. 1 is a top perspective view of an embodiment of an electrical connector assembly of the present invention.
Figure 2:
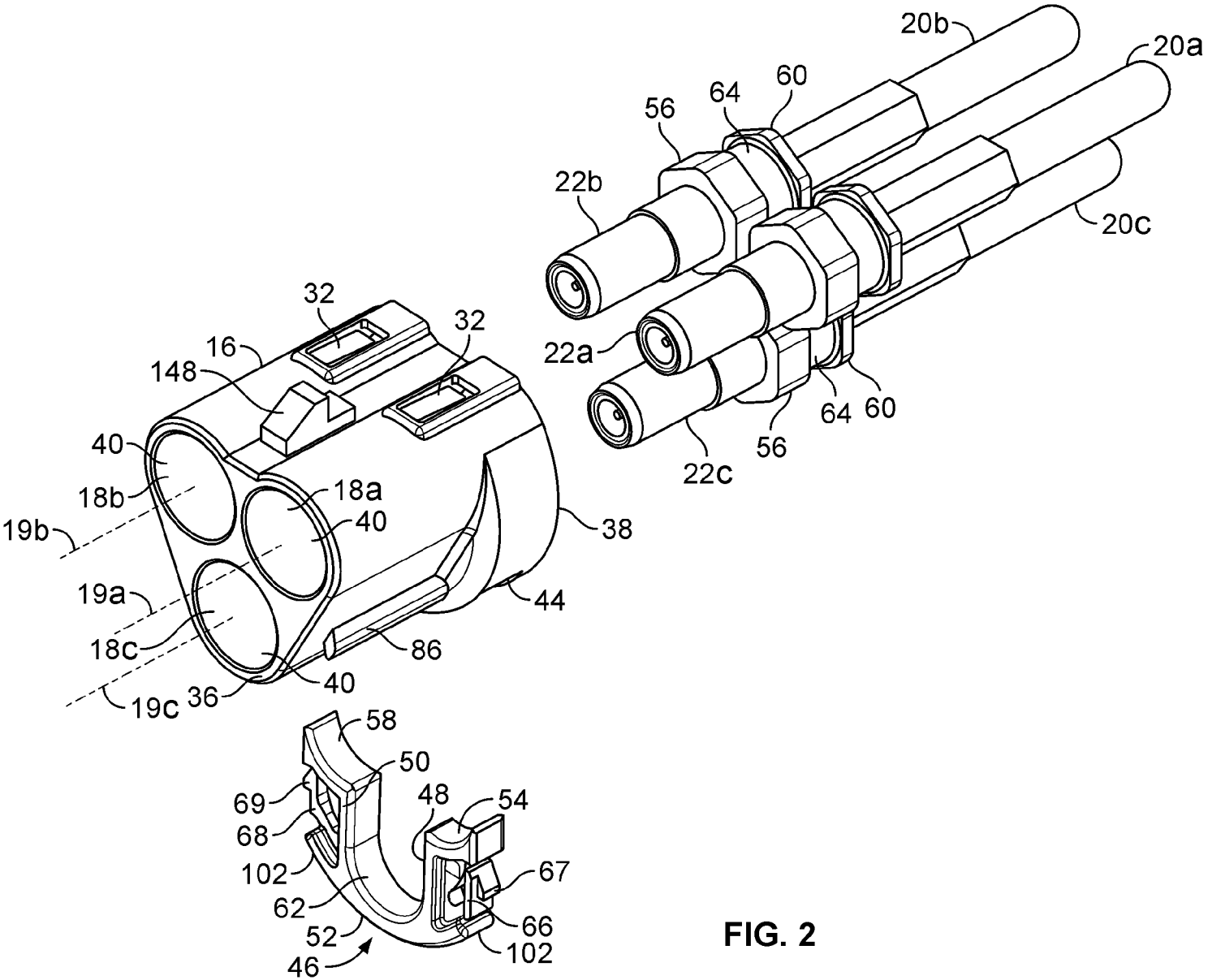
FIG. 2 is an exploded perspective view of a jack housing and corresponding jack connectors of the present invention.
Figure 3:
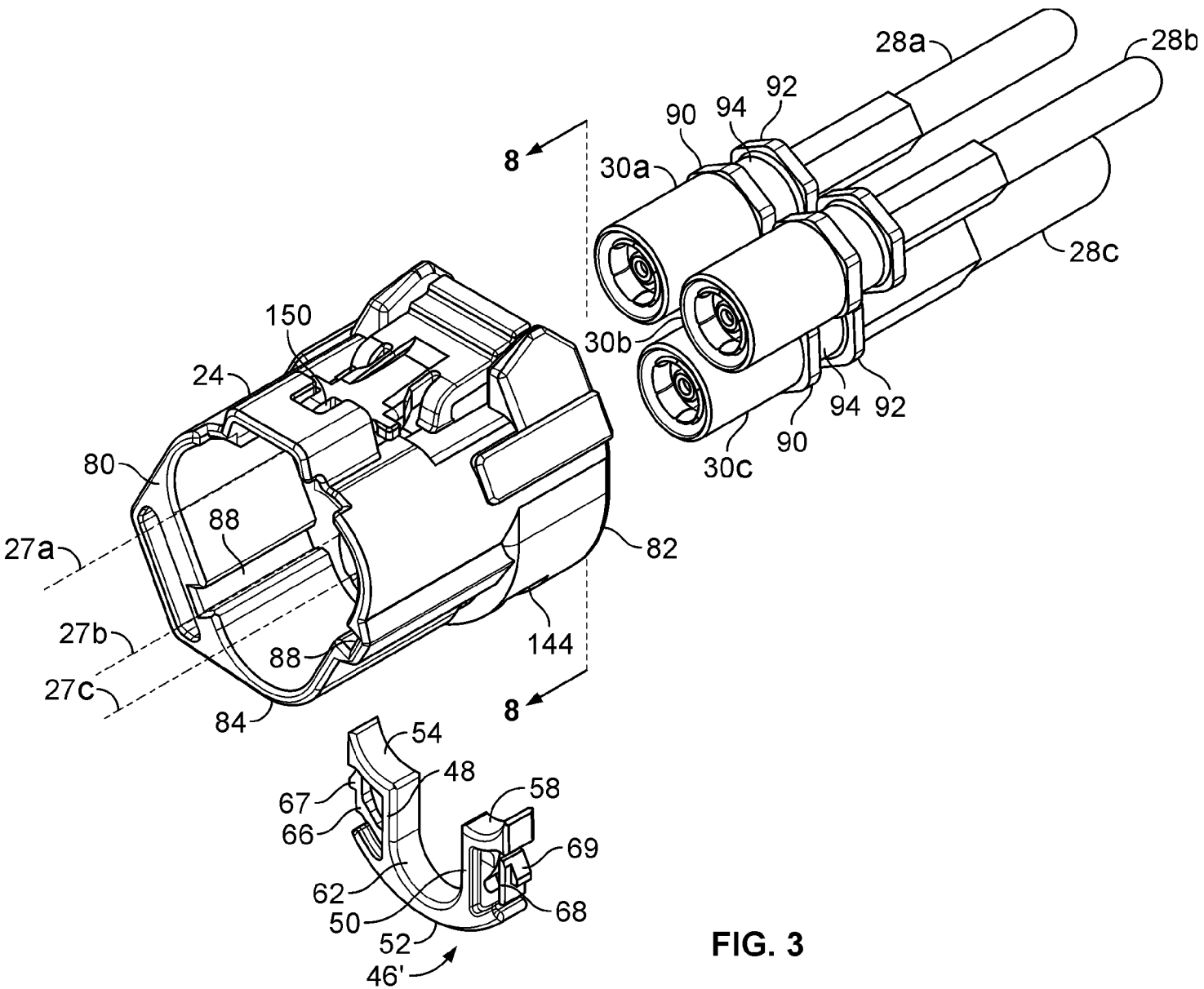
FIG. 3 is an exploded perspective view of a plug housing and corresponding plug connectors of the present invention.

Referring initially to FIGS. 1-3, an electrical connector assembly 10 according to the present invention includes a jack assembly 12 which is configured to couple to a plug assembly 14. The jack assembly 12 includes a body or jack housing 16 having at least one, and as shown, a plurality of channels or axial passageways 18*a*, 18*b*, 18*c* which define respective longitudinal axes 19*a*, 19*b*, 19*c* and are configured to receive corresponding coaxial cables 20*a*, 20*b*, 20*c*. Coaxial cables 20*a*, 20*b*, 20*c* each include a conventional jack connector 22 that is referred to in the figures as 22*a*, 22*b*, 22*c*.

Plug assembly 14 similarly includes a body or plug housing 24 having a plurality of channels or axial passageways 26*a*, 26*b*, 26*c* (FIG. 7) which define longitudinal axes 27*a*, 27*b*, 27*c* and are configured to receive coaxial cables 28*a*, 28*b*, 28*c*. Each of the coaxial cables 28*a*, 28*b*, 28*c* includes a conventional plug connector 30 that is referred to in the figures as 30*a*, 30*b*, 30*c*. Each plug connector 30 is configured to receive a corresponding jack connector 22 and provide electrical communication between respective cables 20*a*, 20*b*, 20*c* and 28*a*, 28*b*, 28*c*.

It is to be understood that elements, such as jack connector 22 and plug connector 30, are also referred to with an suffix, i.e., 22*a*, 22*b*, 22*c*, 30*a*, 30*b*, 30*c*, and that while an element number without the suffix is intended to collectively refer to the particular element, the terms may be used interchangeably.

Figure 5:
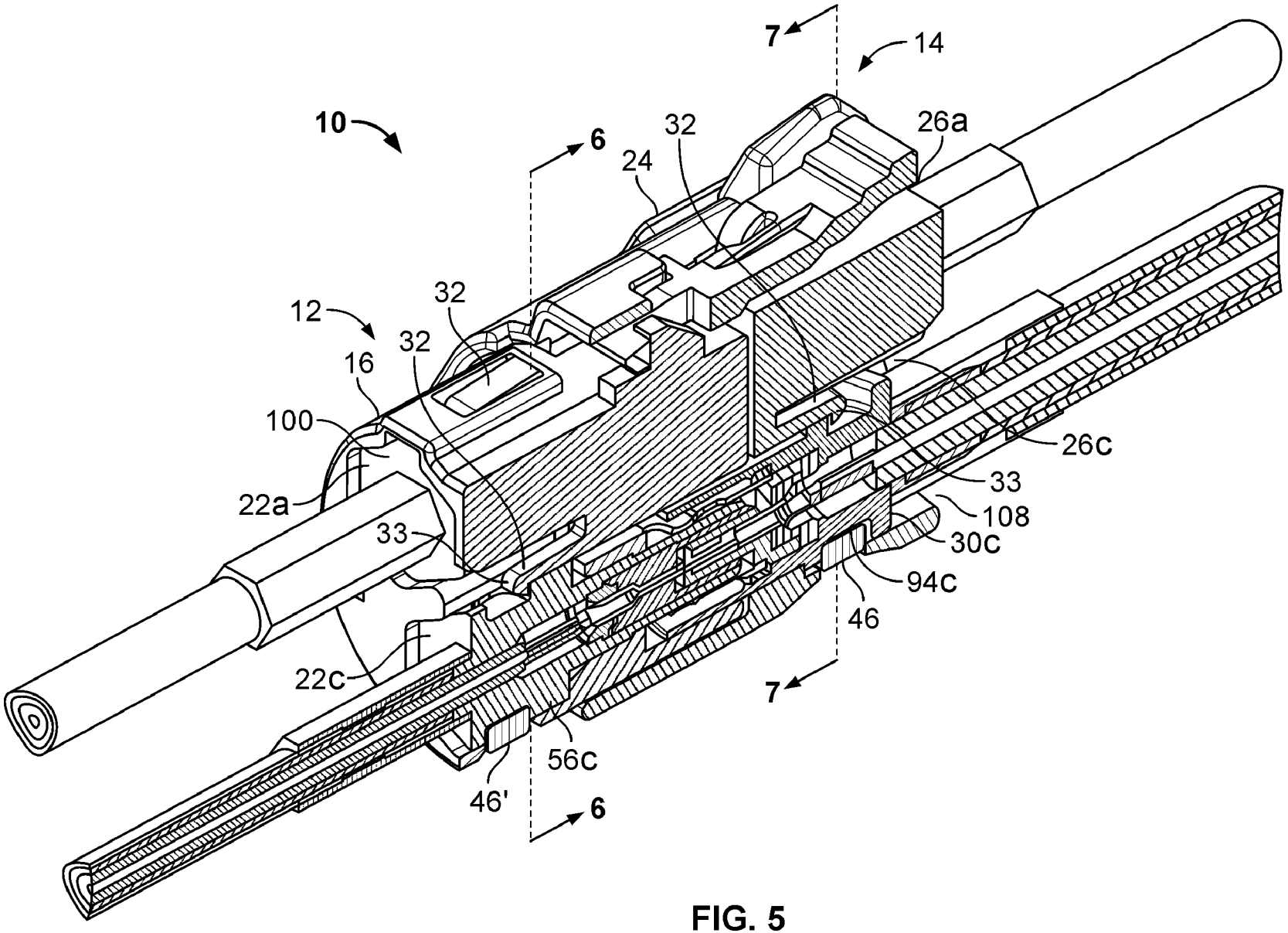
FIG. 5 is a cross section cutaway of FIG. 1 of the present invention.
Figure 6:
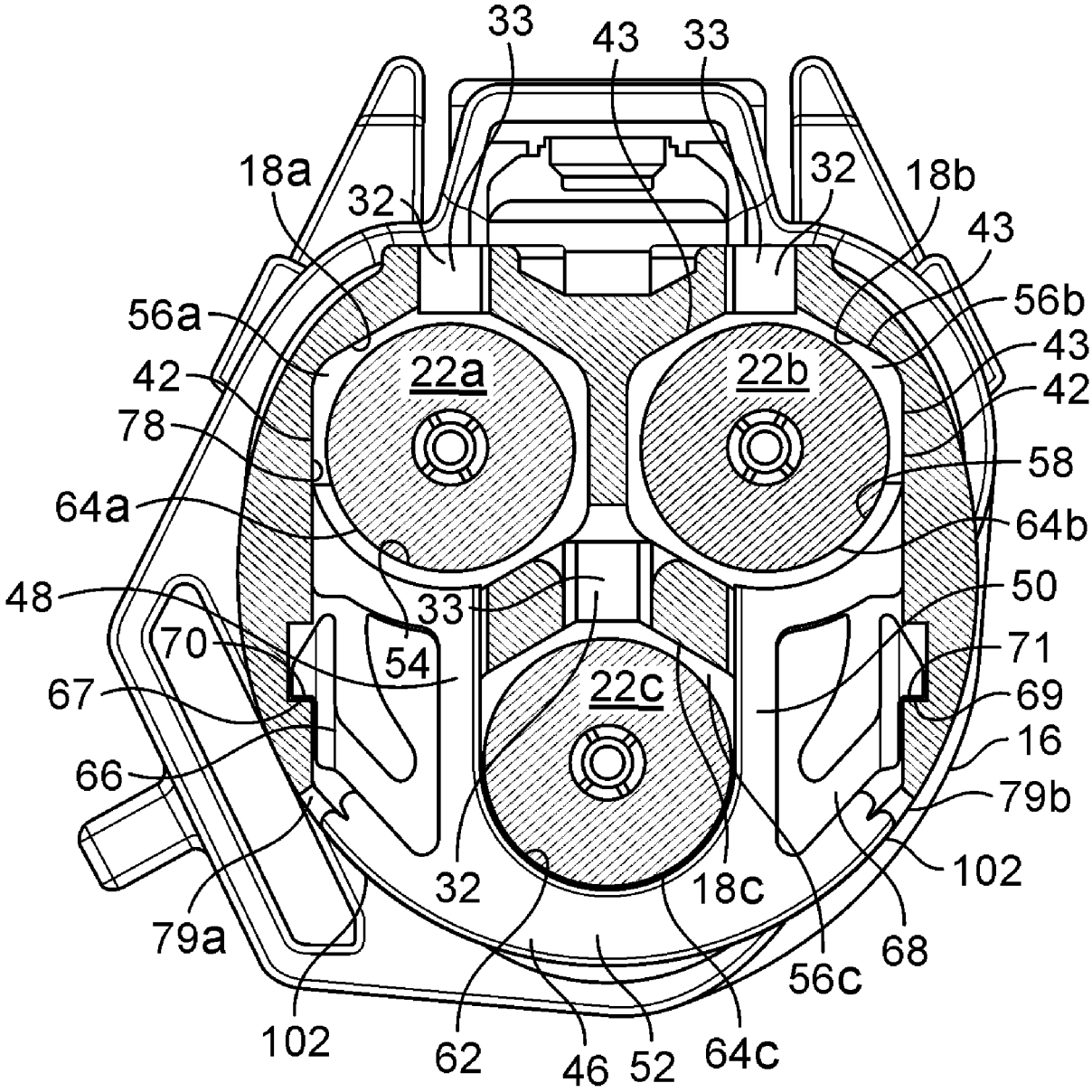
FIG. 6 is a cross section of a jack connector taken along line 6-6 of FIG. 1, which is more precisely located by line 6-6 of FIG. 5 of the present invention.

With reference to FIGS. 1, 2, and 6, the jack housing 16 includes a front mating end 36 and a rear connector receiving end 38. As shown in FIGS. 1 and 2, the passageways 18*a*, 18*b*, 18*c* each include a cylindrical portion 40 (FIG. 2) adjacent the mating end 36 and a non-cylindrical, illustratively hexagonal, portion 42 (FIGS. 1 and 6) adjacent the connector receiving end 38 (FIG. 2). FIG. 6 is a cross section of jack assembly 12 taken along line 6-6 of FIG. 1, the location of line 6-6 with respect to jack assembly 12 being more precisely located as shown in FIG. 5. Passageways 18*a*, 18*b*, 18*c* are positioned such that the hexagonal portions 42 facilitate efficient space utilization. More particularly, each hexagonal portion 42 includes six planar walls or flats 43, wherein at least one of the flats 43 of each hexagonal portion 42 extends parallel to and in close proximity to one of the flats 43 of an adjacent hexagonal portion 42. The proximity of parallel flats 43 conserves space by closely positioning the longitudinal axes 19 of the axial passageways 18. In the illustrative embodiment, each hexagonal portion 42 shares a pair of flats 43 with the two adjacent hexagonal portions 42.

Figure 7:
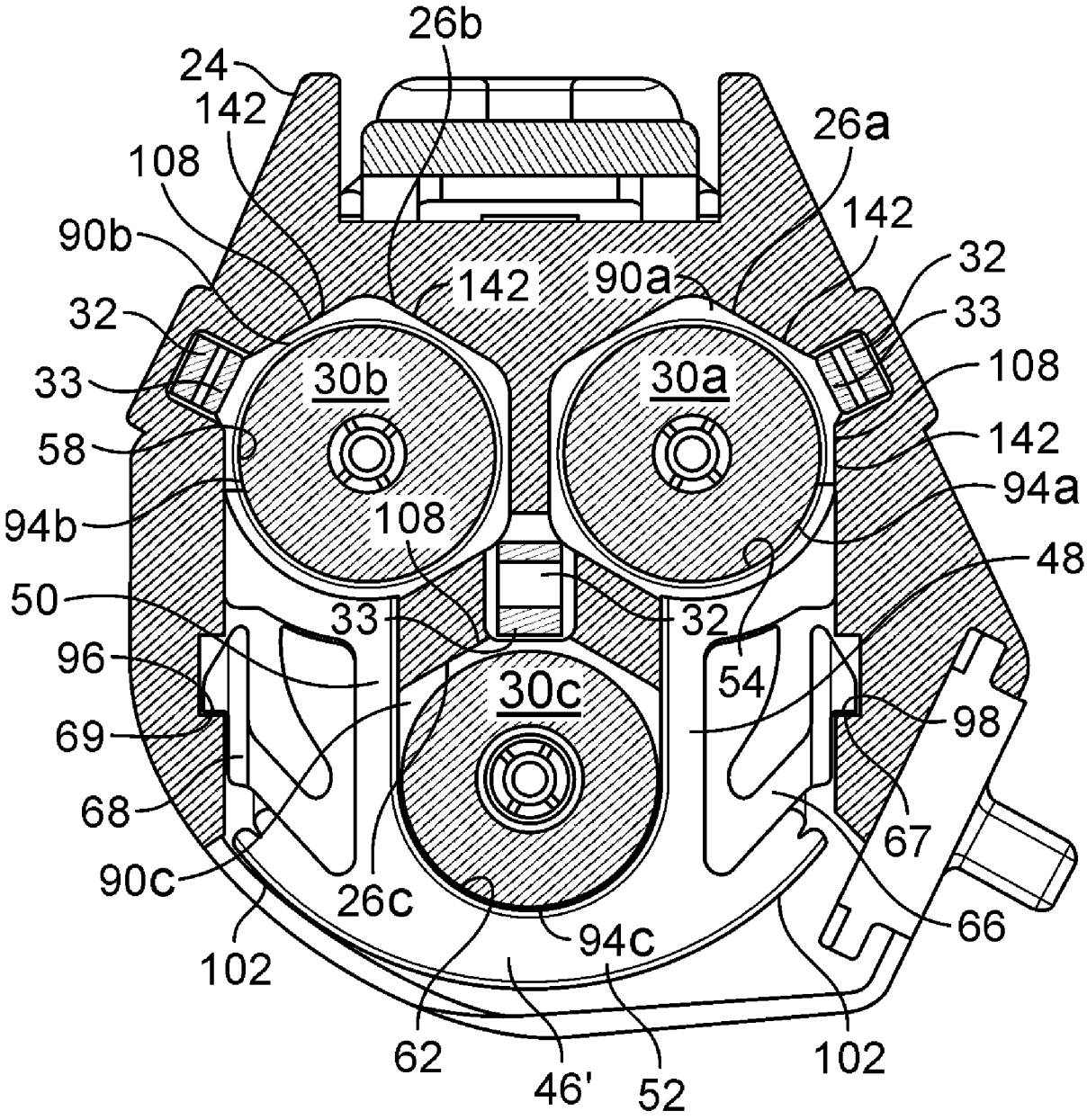
FIG. 7 is a cross section of a plug connector taken along line 7-7 of FIG. 1, which is more precisely located by line 7-7 of FIG. 5 of the present invention.

Referring to FIGS. 1 and 4-7, jack housing 16 and plug housing 24 each include a plurality of connector position assurance devices (CPA) 32. Each CPA 32 includes a retainer 33, such as a hook, for securing a corresponding shoulder 56 (FIG. 2) of jack connectors 22*a*, 22*b* and 22*c*. As shown in FIG. 6, a retainer 33 of a corresponding CPA 32 is inwardly biased from each of passageways 18*a*, 18*b* and 18*c* to secure each of shoulders 56*a*, 56*b* and 56*c*. As shown in FIG. 7, a retainer 33 of a corresponding CPA 32 is inwardly biased from each of passageways 26*a*, 26*b* and 26*c* to secure each of shoulders 90*a*, 90*b* and 90*c*. In order to maximize the retention of shoulders 56*a*, 56*b*, 56*c*, 90*a*, 90*b* and 90*c*, each retainer 33 is disposed to engage the shoulders along a junction, i.e., corners, between adjacent flats of the respective hexagonal portions of the hexagonal peripheries of the shoulders. As shown, to ensure engagement along the corners of the shoulders 56*a*, 56*b*, 56*c*, 90*a*, 90*b* and 90*c* is achieved, the desired alignments of the shoulders are maintained by the selective positioning (or rotation) (or clocking) of the hexagonal connectors including shoulders 56*a*, 56*b*, 56*c*, 90*a*, 90*b* and 90*c* to engage (or mate) axial hexagonal passageways 18*a*, 18*b*, 18*c*, 26*a*, 26*b*, 26*c* formed in respective jack housing 16 and plug housing 24 into which the hexagonal connectors are inserted.

In one embodiment, as shown in FIG. 1, the upper CPAs 32 can be accessed by insertion of a tool (not shown) though notched openings 100 formed to further enlarge axial passageways 18*a* and 18*b*. In a preferred embodiment, the tool is a blade screwdriver. Such insertion and access by the tool would be substantially parallel to the corresponding axial passageway. It is to be understood that while CPAs 32 are shown (FIGS. 6 and 8) with two of the three CPAs adjacent the outer surface of housings 16 and 24 and one CPA centrally disposed substantially in the housings, a CPA can be located at any position in the housings to secure a shoulder of a connector. For example, in one embodiment, a single CPA could contain an enlarged retainer that could be used to secure more than one connector, such as a centrally disposed CPA in either FIG. 6 or 7. By virtue of the CPAs, each corresponding connector is secured in desired alignment and permitting insertion of a secondary connector position assurance device (SCPA) 46, as shown in FIGS. 2 and 3, and discussed in additional detail below. In one embodiment, CPA 32 produces an audible clicking sound to confirm secure engagement with the corresponding connector has been achieved. In addition, as shown in FIG. 1, actuation of the CPA 32 is also visually verifiable.

Although CPAs could be separate components that are fastened, adhered or otherwise connected to the connector housings, in one embodiment, the CPAs are of unitary construction with the housings.

As shown in FIGS. 1 and 2, in addition to axial passageways 18*a*, 18*b*, 18*c*, the jack housing 16 includes a transverse slot 44 configured to slidably receive a lock or secondary connector position assurance device (SCPA) 46. With reference to FIGS. 2, 5 and 6, the SCPA 46 includes a first leg 48, a second leg 50, and an arcuate bridge member 52 connecting the first leg 48 and the second leg 50. A first arcuate engagement surface 54 is supported by the first leg 48 and is configured to engage a shoulder 56*a* (FIG. 6) of the first jack connector 22*a* to restrict axial movement of the first jack connector 22*a*. Similarly, a second arcuate engagement surface 58 is supported by the second leg 50 and is configured to engage a shoulder 56*b* of the second jack connector 22*b* to restrict axial movement of the second jack connector 22*b*. A third arcuate engagement surface 62 is supported by the bridge member 52 and is configured to engage shoulder 56*c* of the third electrical connector 22*c* to restrict axial movement of the third electrical connector 22*c*.

The first engagement surface 54 has a first radius of curvature, the second engagement 58 has a second radius of curvature and the third engagement surface 62 has a third radius of curvature. In one illustrative embodiment, the third radius of curvature is greater than both the first radius of curvature and the second radius of curvature, such as to facilitate positioning of a larger jack connector 22*c* within the axial passageway 18*c*.

First latch arm 66 extends upwardly from an extension 102 adjacent to bridge member 52 such that first leg 48 is disposed between second leg 50 and first latch arm 66. Similarly, second latch arm 68 extends upwardly from an extension 102 adjacent to bridge member 52 such that second leg 50 is disposed between first leg 48 and second latch arm 68. First latch arm 66 includes a latch 67 that is configured to engage a recess 70 to secure SCPA 46 to the jack housing 16. Second latch arm 68 includes a latch 69 that is configured to engage a recess 71 to secure SCPA 46 to the jack housing 16. The first and second latch arms 66 and 68 are illustratively formed as an integral part of the SCPA 46 and are resiliently biased in a direction away from each other. More particularly, the latches 67 and 69 are biased outwardly to couple the SCPA 46 to respective recesses 70 and 71 defined by an internal wall 78 of the jack housing 16 (FIG. 6). A pair of slots 79*a* and 79*b* are illustratively positioned at opposing ends of extensions 102 of bridge member 52 and are configured to receive a tool (not shown) for facilitating removal of the SCPA 46 from the housing 16.

Referring back to FIGS. 1, 2 and 6, jack connectors 22*a*, 22*b*, 22*c* each include known coaxial components for establishing electrical connections therethrough and are not discussed in further detail. The housings of jack connectors 22*a*, 22*b*, 22*c* each include radially outwardly extending flanges or shoulders 56 and 60 which define an annular groove 64 therebetween. In one embodiment, groove 64 includes a cylindrical cross section. Shoulders 56 and 60 illustratively have a hexagonal cross section and are configured to cooperate with the hexagonal portion 42 of the axial passageways 18*a*, 18*b*, 18*c* when the jack connectors 22 are inserted into jack housing 16. When jack connectors 22 are completely installed, annular groove(s) 64 of jack connectors 22 align with transverse slot 44 of the jack housing 16 and SCPA 46 may be installed to verify proper installation and prevent separation. The engagement surfaces 54, 58, 62 of the SCPA 46 are configured to be received within the grooves 64 such that engagement with the shoulders 56 and 60 restricts axial movement of the jack connectors 22*a*, 22*b*, 22*c*.

Figure 4:
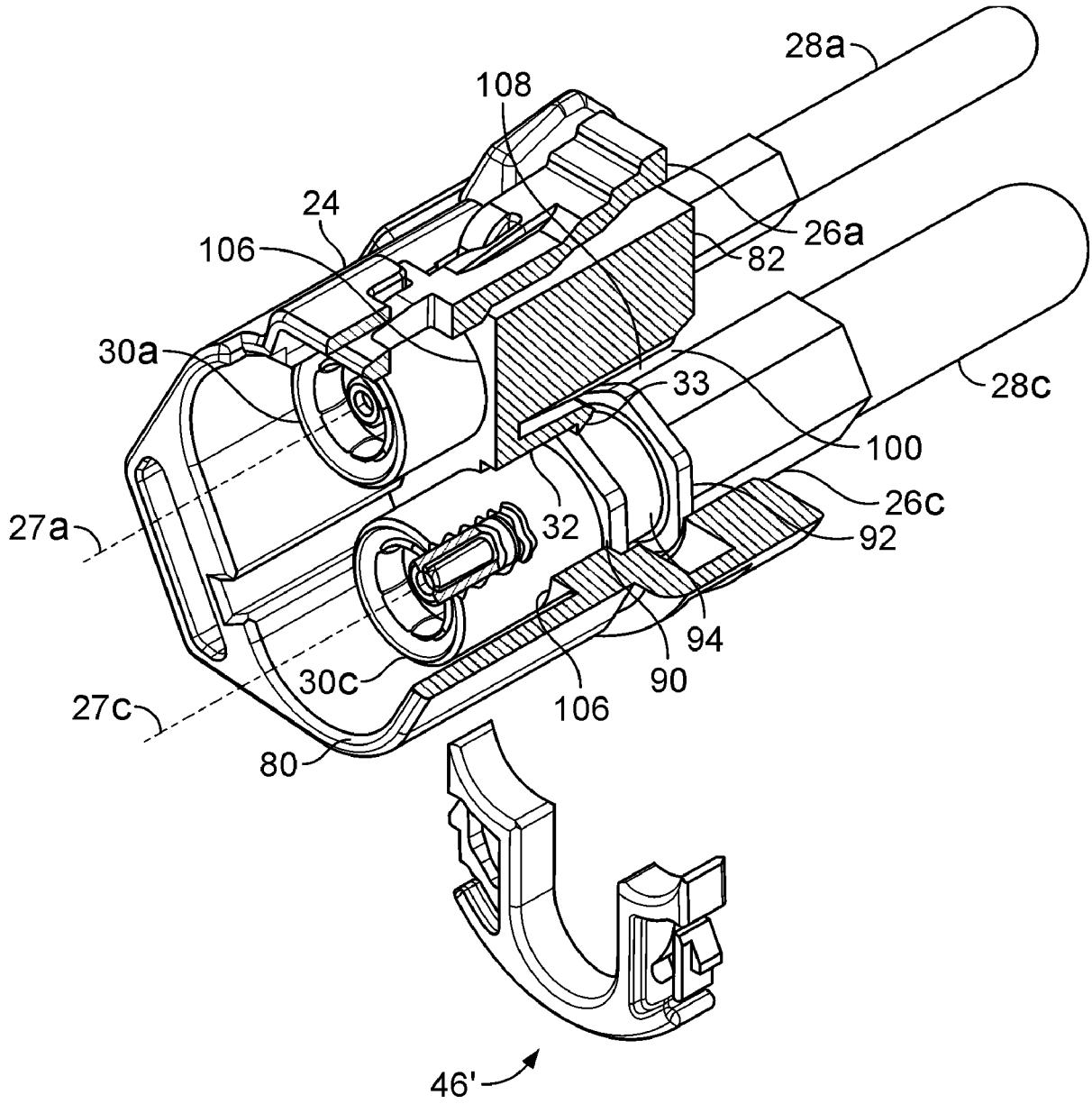
FIG. 4 is a partial cutaway top perspective view showing plug connectors installed in the plug housing of the present invention.

With reference to FIGS. 2-4, plug housing 24 includes a front mating end 80 and a rear connector receiving end 82. The mating end 80 includes a receiving flange 84 configured to slidably receive the mating end 36 of the jack housing 16. The jack housing 16 includes a plurality of alignment ribs 86 which are configured to be received within alignment grooves 88 formed within the plug housing 24. By ensuring such positioning, the passageways 18 of the jack housing 16 are coaxially aligned with the passageways 26 of the plug housing 24. In one embodiment, jack housing 16 can include one alignment rib 86.

Referring to FIGS. 1, 4, 5 and 7, the passageways 26*a*, 26*b*, 26*c* each include a cylindrical portion 106 adjacent to the mating end 80 and a non-cylindrical, illustratively hexagonal, portion 108 adjacent the connector receiving end 82 (FIG. 4). As shown, passageway 26*c* is positioned vertically above passageways 26*a* and 26*b* and is laterally offset therefrom. In such an arrangement, the hexagonal portions 108 facilitate efficient space utilization by placing the passageways 26*a*, 26*b*, 26*c* in close proximity to each other. More particularly, each hexagonal portion 108 includes six flats 142, wherein at least one of the flats 142 of each hexagonal portion 108 extends parallel to and in close proximity to one of the flats 142 of an adjacent hexagonal portion 108. The proximity of parallel flats 142 conserves space by closely positioning the longitudinal axes 27 of the axial passageways 26. In the illustrative embodiment, each hexagonal portion 108 shares flats 142 with the two adjacent hexagonal portions 108. In addition to the axial passageways 26, the plug housing 24 includes a transverse slot 144 (FIG. 3) configured to slidably receive a connector position assurance device (SCPA) 46'. SCPA 46' is illustratively identical to the SCPA 46 described in detail above.

Referring back to FIGS. 1, 3 and 7, plug connectors 30*a*, 30*b*, 30*c* each include known coaxial components for establishing electrical connections therethrough and are not discussed in further detail. The housings of plug connectors 30*a*, 30*b*, 30*c* each include radially outwardly extending flanges or shoulders 90 and 92 which define an annular groove 94 therebetween. In one embodiment, groove 94 includes a cylindrical cross section. Shoulders 90 and 92 illustratively have a hexagonal cross section and are configured to cooperate with the hexagonal portion 142 of the axial passageways 26*a*, 26*b*, 26*c*. The engagement surfaces 54, 58, 62 of the SCPA 46' are configured to be received within the grooves 94 such that engagement with the shoulders 90 and 92 restricts axial movement of the jack connectors 30*a*, 30*b*, 30*c*.

Figure 8:
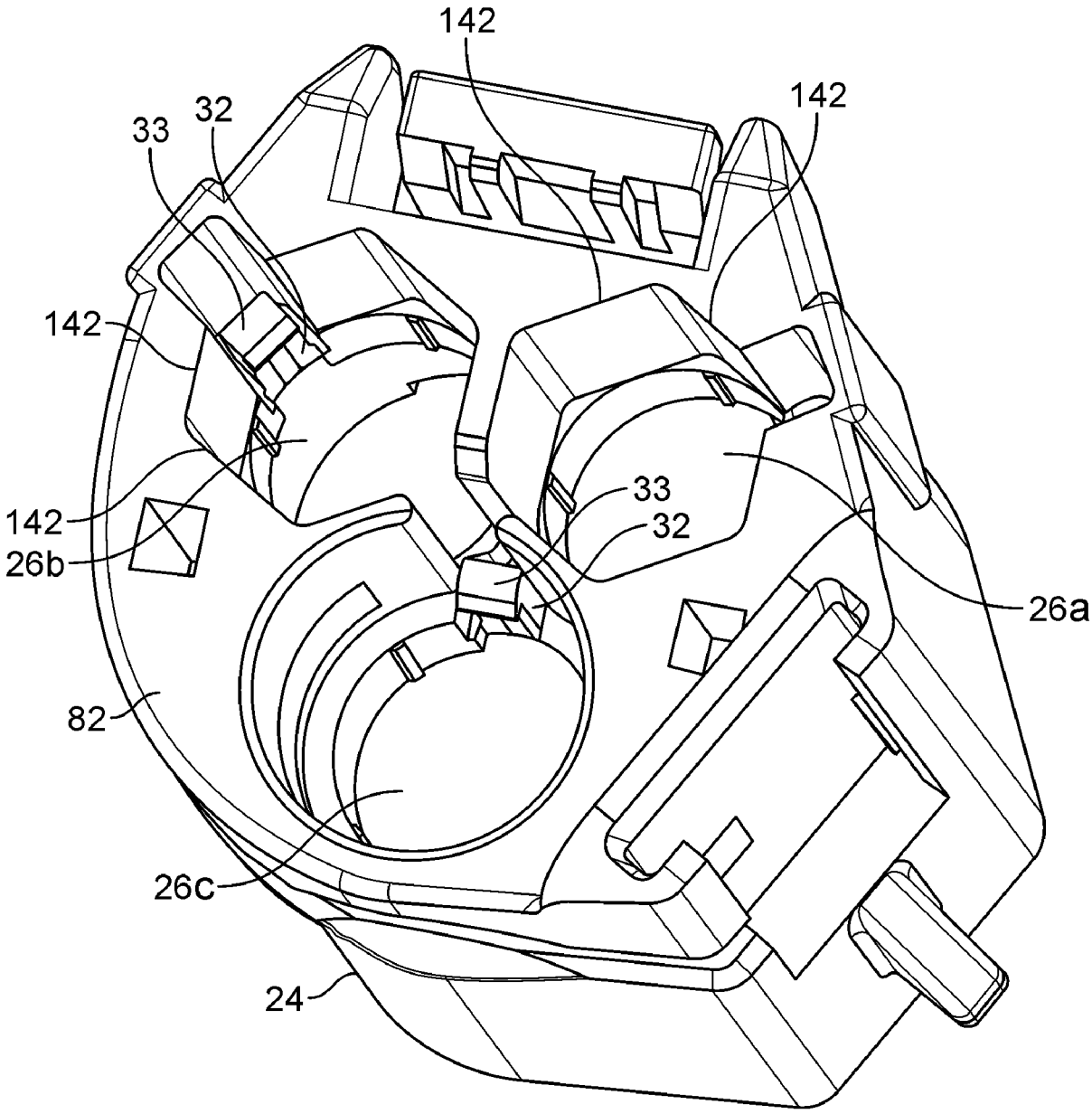
FIG. 8 is a bottom perspective view of a receiving end of a plug housing taken along line 8-8 of FIG. 3 of the present invention.
Figure 9:
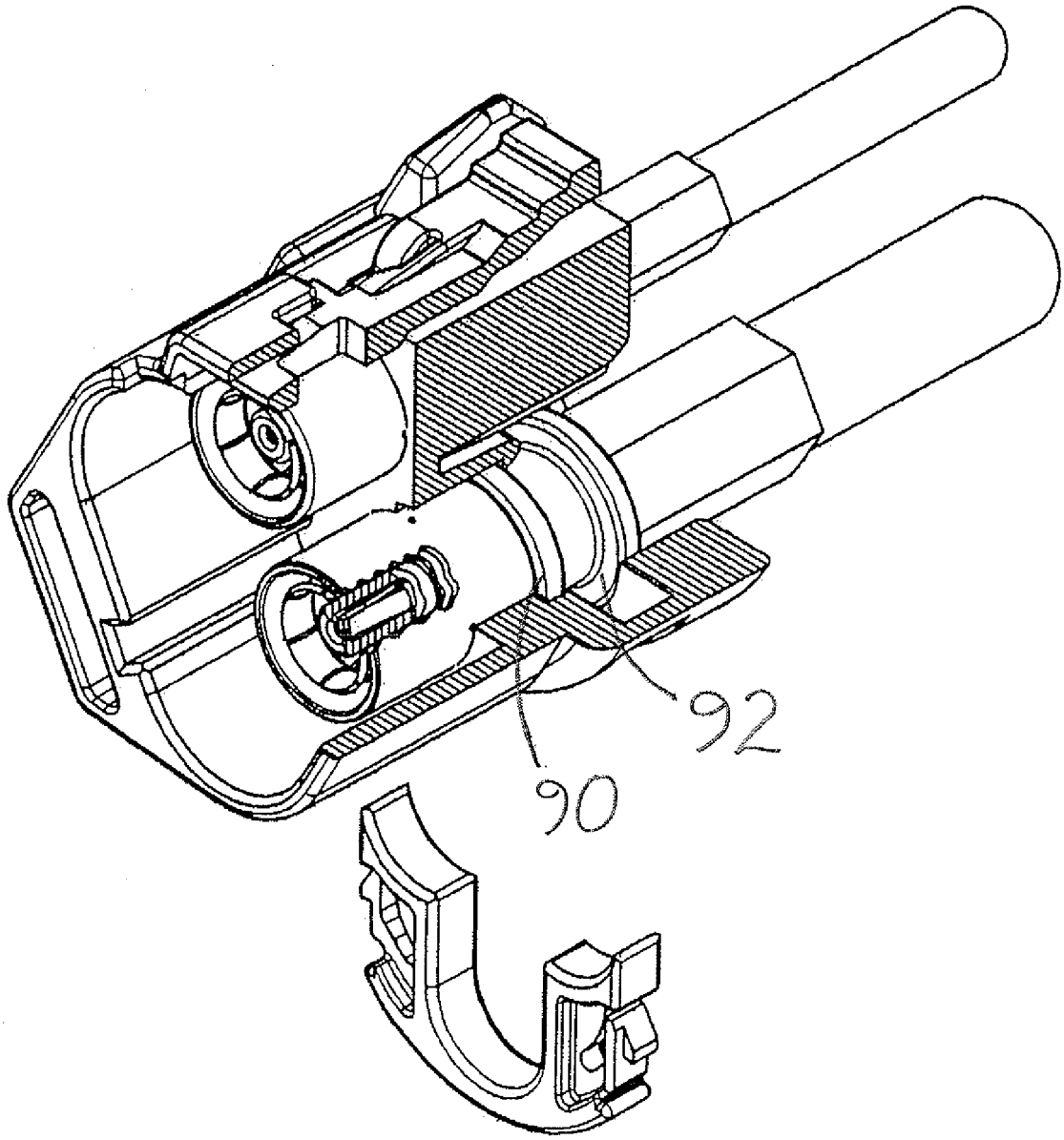
FIG. 9 is an exploded perspective view of an embodiment of a plug housing and corresponding plug connectors of the present invention.

In an alternate embodiment, as shown in FIG. 8, which is a bottom perspective view of receiving end 82 of plug housing 24, axial passageway 26*c* is circular. That is, instead of shoulders 90 and 92 (FIG. 3) being hexagonal, shoulders 90 and 92 are circular (FIG. 9). This construction permits a larger cable to be used with plug connector 30*c* (FIG. 3). Use of larger diameter cables can result in high torque forces that are associated with twisting of the larger diameter cables, i.e., plug connector 30*c* within passageway 26*c*, during routing of the plug housing 24 in the desired application. By virtue of both plug connector 30*c* and passageway 26*c* being circular, plug connector 30*c* can rotate within passageway 26*c*, thus relieving and removing the high torque forces that would otherwise occur if the plug connector 30*c* were constrained from rotational movement. It is to be understood that any of passageways 26*a*, 26*b*, 26*c*, 18*a*, 18*b* and 18*c* of either plug housing 24 (FIG. 7) or jack housing 16 (FIG. 6) can utilize circular constructions, if desired. It is also to be understood that the plug connectors and jack connectors can be of different sizes, so long as the mating plug and jack connectors are suitably sized.

As shown in FIG. 1, a latch 146 may be configured to releasably couple the jack housing 16 with the plug housing 24. More particularly, a catch 148 (FIG. 2) supported by the jack housing 16 may be positioned within an opening 150 (FIG. 3) supported by the plug housing 14 to secure together the jack assembly 12 and plug assembly 14.

It is to be understood that inserts (not shown) shaped similar to the plug and jack connectors can be inserted into a corresponding axial passageway(s), to convert the three position connector assemblies to a two position or even one position connector assembly, if desired. Alternate suitable means to connect jack housing 16 and plug housing 24 are known to those skilled in the art.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A housing for use in an electrical connector assembly, the housing comprising:

a body having at least one axial passageway for receiving an electrical connector having a housing and a contact therein;

a position assurance device extending into the at least one axial passageway and configured to engage a shoulder of the electrical connector to restrict axial movement; and a secondary connector position assurance device having a pair of resilient latch arms extending outwardly and facing away from each other is received in the body engaging the shoulder of the electrical connector to restrict axial movement of the electrical connector, wherein each of the latch arms secured proximate a leg having an arcuate engagement surface.

2. The housing of claim 1 wherein the position assurance device and the body are of unitary construction.

3. The housing of claim 1 wherein the position assurance device is a hook.

4. The housing of claim 3 wherein the shoulder defines a circular periphery.

5. The housing of claim 3 wherein the shoulder defines a hexagonal periphery.

6. The housing of claim 5 wherein the hook engages a corner of the hexagonal periphery.

7. The housing of claim 1 wherein the position assurance device is accessible for disengagement from the electrical connector along an axis substantially parallel to the channel.

8. A housing for use in an electrical connector assembly, the housing comprising:

a body having a first channel for receiving a first electrical connector having a housing and a contact therein;

a first position assurance device extending into the first channel and configured to engage a shoulder of the first electrical connector to restrict axial movement of the first electrical connector;

the body having a second channel for receiving a second electrical connector having a housing and a contact therein;

a second position assurance device extending from the second channel and configured to engage a shoulder of the second electrical connector to restrict axial movement of the second electrical connector;

the body having a third channel for receiving a third electrical connector having a housing and a contact therein;

a third position assurance device extending from the third channel and configured to engage a shoulder of the third electrical connector to restrict axial movement of the third electrical connector; and a secondary connector position assurance device having legs, each leg having an arcuate engagement surface and a resilient latch arm extending outwardly therefrom and secured proximate the leg that is received in the body to engage a shoulder of each of the electrical connectors to restrict axial movement of the electrical connectors.

9. The housing of claim 8 wherein the position assurance devices and the body are of unitary construction.

10. The housing of claim 8 wherein each position assurance device is a hook.

11. The housing of claim 10 wherein at least one shoulder defines a hexagonal periphery.

12. The housing of claim 10 wherein at least one shoulder defines a circular periphery.

13. The housing of claim 11 wherein each hook engages a corner of the hexagonal periphery.

14. The housing of claim 8 wherein each position assurance device is accessible for disengagement from the electrical connector along an axis substantially parallel to the channel.

15. The housing of claim 8 wherein the body receives the secondary connector position assurance device in a radial direction.

16. The housing of claim 8 wherein the secondary position assurance device includes a latch for engaging the body.

17. The housing of claim 16 wherein each latch further comprises a pair of latch arms facing away from each other.

18. An electrical connector assembly comprising:

a housing including a plurality of axial passageways, a transverse slot and a plurality of position assurance devices;

a plurality of electrical connectors each having a housing and a contact therein and configured to be received within the plurality of axial passageways, each of the electrical connectors including a shell having a shoulder and an annular groove, each shoulder engaging a corresponding position assurance device;

a secondary connector position assurance device having legs configured to be received within the transverse slot, the secondary position assurance device including a plurality of arcuate engagement surfaces on the legs and resilient latch arms extending outwardly therefrom and facing away from each other and secured proximate the legs, each of the engagement surfaces configured to be received within one of the annular grooves of the shells.

* * * * *